US009733621B2

(12) United States Patent
Lechot et al.

(10) Patent No.: US 9,733,621 B2
(45) Date of Patent: Aug. 15, 2017

(54) SHOCK ABSORBER WITH A BAYONET FITTING

(71) Applicant: The Swatch Group Research and Development Ltd, Marin (CH)

(72) Inventors: Dominique Lechot, Reconvilier (CH); Alain Zaugg, Le Sentier (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 14/890,055

(22) PCT Filed: May 21, 2014

(86) PCT No.: PCT/EP2014/060441

§ 371 (c)(1),
(2) Date: Nov. 9, 2015

(87) PCT Pub. No.: WO2014/187858

PCT Pub. Date: Nov. 27, 2014

(65) Prior Publication Data

US 2016/0124389 A1 May 5, 2016

(30) Foreign Application Priority Data

May 24, 2013 (EP) ..... 13169101

(51) Int. Cl.
*G04B 31/02* (2006.01)
*G04B 31/04* (2006.01)

(52) U.S. Cl.
CPC ..... *G04B 31/04* (2013.01); *G04B 31/02* (2013.01)

(58) Field of Classification Search
CPC ..... G04B 31/00; G04B 31/012; G04B 31/02; G04B 31/04
See application file for complete search history.

(56) References Cited

U.S. PATENT DOCUMENTS 3,306,027 A * 2/1967 Schneider ..... G04B 31/016 368/326
3,712,051 A * 1/1973 Romang ..... G04B 31/04 368/326

(Continued)

FOREIGN PATENT DOCUMENTS

CH 330 901 A 6/1958
CH 343 935 A 12/1959

(Continued)

OTHER PUBLICATIONS

International Search Report Issued Jul. 28, 2014, in PCT/EP14/060441 Filed May 21, 2014.

*Primary Examiner* — Vit W Miska
(74) *Attorney, Agent, or Firm* — Oblon, McClelland, Maier & Neustadt, L.L.P.

(57) ABSTRACT

A shock absorber device for an arbor of a timepiece element including: a support including a base cup surmounted by a peripheral rim, which is delimited, opposite the cup, by an upper surface, the cup and the rim together defining a housing; a pivot system extending along an arbor, the pivot system being arranged in the housing and including a base including an elastic return mechanism at the periphery thereof, formed by at least one curved arm, including an opening in which is inserted a pivot element configured to cooperate with the arbor. The at least one curved arm is used for locking the pivot system in a bayonet fitting.

10 Claims, 4 Drawing Sheets

(56) References Cited

U.S. PATENT DOCUMENTS

| | | | | |
|---|---|---|---|---|
| 7,234,859 | B2 * | 6/2007 | Kohler | G04B 31/04<br>368/326 |
| 7,344,303 | B2 * | 3/2008 | Conus | G04B 31/04<br>368/324 |
| 8,702,301 | B2 * | 4/2014 | Hiraoka | G04B 17/06<br>368/324 |

FOREIGN PATENT DOCUMENTS

| | | | |
|---|---|---|---|
| CH | 702 314 | B1 | 6/2011 |
| DE | 76 09 030 | U1 | 7/1976 |
| EP | 2 015 147 | A2 | 1/2009 |
| FR | 1 008 173 | A | 5/1952 |
| WO | 2009/060074 | A1 | 5/2009 |

* cited by examiner

SHOCK ABSORBER WITH A BAYONET FITTING

CROSS-REFERENCE TO RELATED APPLICATIONS

This is a National phase application in the United States of International patent application PCT/EP2014/060441 filed May 21, 2014 which claims priority on European patent application No. 13169101.6 filed May 24, 2013. The entire disclosures of the above patent applications are hereby incorporated by reference.

The present invention concerns a shock absorber device for an arbor of a timepiece element including a hollow support comprising a base cup surmounted by a peripheral rim, delimited, opposite said cup, by an upper surface, said cup and the rim together defining a housing, the device further including a pivot system extending along an arbor, said pivot system being arranged in said housing and formed of a base comprising elastic return means at the periphery thereof, formed by at least one curved arm, and having an opening in which is inserted a pivot element able to cooperate with an arbor.

BACKGROUND OF THE INVENTION

There are known shock absorber devices for arbors of timepiece element such as balances or arbors carrying a toothed wheel including a support in which a housing is arranged. This housing has a pierced base through which the arbor shank passes and an inner wall. The device further includes a pivot system 1, seen in FIG. 1, arranged in said housing and including a base 2 that comprises elastic return means 3 at its periphery. These return means take the form of arms 4 and are connected by a first end to base 2 and by a second end to an annular peripheral part 5, as seen in FIG. 1.

The base has an opening 6 in which is inserted a pivot element able to cooperate with an arbor. This pivot element and the base may form a single piece.

During assembly of the shock absorber device, the shock absorber device is pressed into the housing in the support.

One drawback of these known shock absorber devices it that they are cumbersome. Indeed, by their nature, devices with arms have a larger surface area than lyre-shaped spring systems. The volume is further increased by the presence of the annular part on which the second ends of the return means are fixed.

Consequently, this type of shock absorber device can only be used in timepiece movements of large dimensions and not in more compact timepiece movements.

Another drawback of these devices is the rigidity of the attachment between the elastic return means, namely the arms, and the annular peripheral part. Indeed, the principle of pressing the device into the housing in the support means that the rigid attachment of the arms to the annular peripheral part behaves as though the arms were rigidly secured to the support. This attachment therefore creates stress in the arms. The arms then have to be sized accordingly to prevent any risk of breakage.

SUMMARY OF THE INVENTION

It is an object of the invention to overcome the drawbacks of the prior art by proposing to provide a shock absorber device which is both more compact and subjected to less stress.

To this end, the invention concerns a shock absorber device for an arbor of a timepiece element including a hollow support comprising a base cup surmounted by a peripheral rim which is delimited, opposite said cup, by an upper surface, said cup and said rim defining together a housing, the device further including at least one pivot system, extending in a direction perpendicular to an arbor D, said at least one pivot system being arranged in said housing and formed of a base 121 including elastic return means 123 at its periphery, formed by at least one curved arm 124, and including a pivot element 122 able to cooperate with said arbor, characterized in that the rim comprises in the thickness thereof at least one cavity including a recess parallel to said arbor D which opens on the upper surface, and, secant with said first recess and opposite the upper surface, a blind groove used for locking a curved arm of said at least one pivot system in a bayonet fitting.

The advantage of this device is that it is more compact and therefore it can be used for timepiece movements of small dimensions.

Further, the bayonet fitting has the advantage of being simple and easier to disassemble than the pressing-in method normally used.

In a first advantageous embodiment, said at least one arm has a free end, said free end engaging in said at least one groove.

In a second advantageous embodiment, the groove includes a hollow in which a catch, located at the free end of said at least one curved arm, is inserted.

In a third advantageous embodiment, the pivot element includes a single jewel.

In another advantageous embodiment, the pivot element includes a setting in which a jewel hole, traversed by the arbor shank, and an endstone are fitted.

In another advantageous embodiment, the pivot element and the base are made in one piece.

In another advantageous embodiment, the elastic return means are formed by three curved arms angularly offset by 120°, said rim including three cavities in the thickness thereof.

In another advantageous embodiment, the shock absorber device further includes an additional spring which, in the event of an axial shock, returns the arbor to its initial position.

In another advantageous embodiment, said additional spring is a lyre-shaped spring taking the form of an open ring including a joint or hinge and two locking tabs.

In another advantageous embodiment, said additional spring is a flat annular spring taking the form of a closed ring having shoulders extending towards the arbor.

In another advantageous embodiment, the device includes two pivot systems using the same cavity for locking one curved arm of each pivot system in a bayonet fitting.

In another advantageous embodiment, the device includes two pivot systems each using a cavity for locking one curved arm of said pivot system in a bayonet fitting.

BRIEF DESCRIPTION OF THE DRAWINGS

The objects, advantages and features of the shock absorber device according to the present invention will appear more clearly in the following detailed description of at least one embodiment of the invention given only as a non-limiting example and illustrated by the annexed drawings, in which.

DETAILED DESCRIPTION

Figure 1:
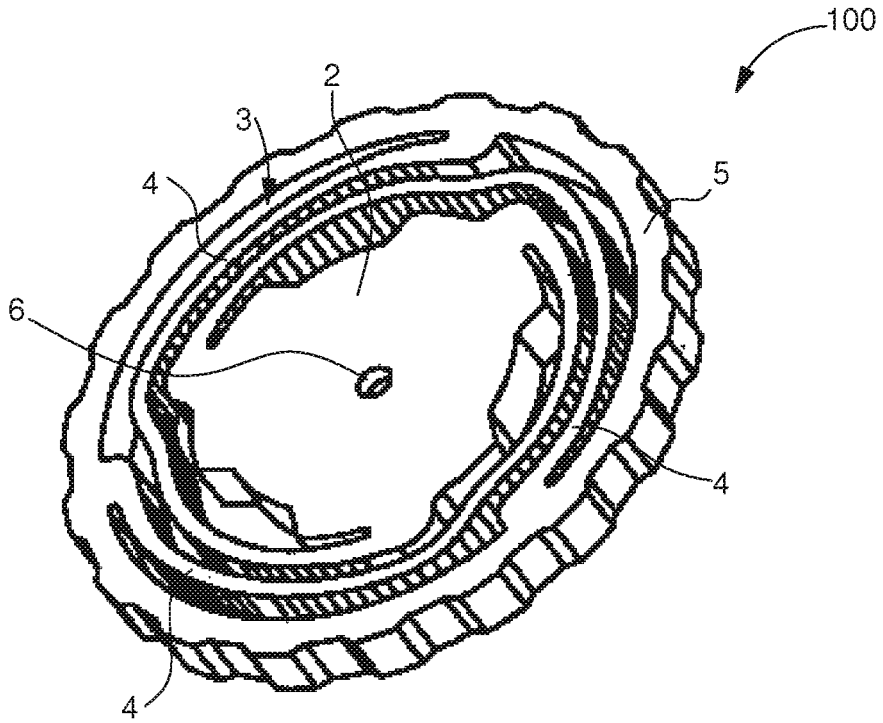
Fig. 1 (Prior Art)
FIG. 1 is a schematic view of a shock absorber device according to the prior art.
Figure 2:
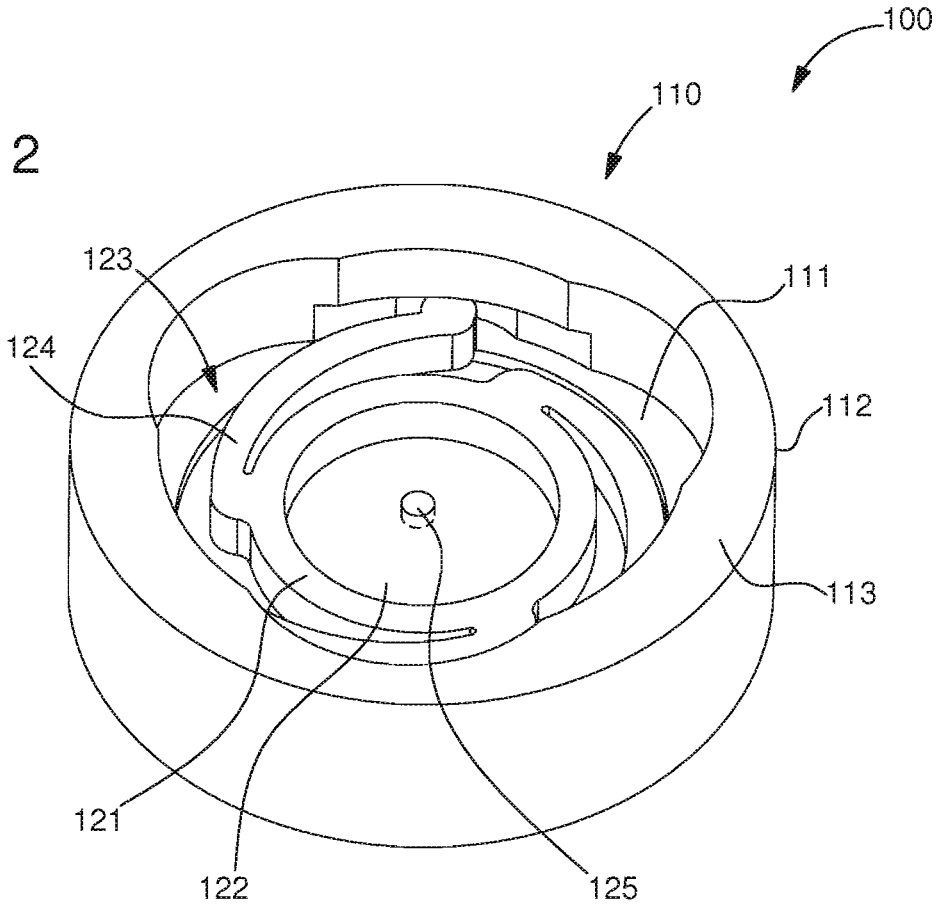
FIG. 2 is a schematic view of a first embodiment of a shock absorber device according to the invention.
Figure 3:
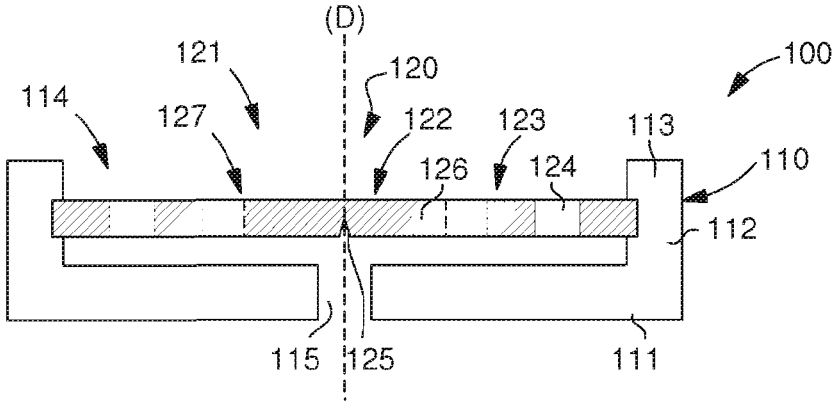
FIG. 3 is a schematic sectional view of the shock absorber device according to the invention.

FIGS. 2 and 3 show a shock absorber device 100 according to a first embodiment of the invention. This shock absorber device can be used for a part of a timepiece.

Shock absorber or shock resistant device 100 includes a hollow support 110 including a base cup 111 surmounted by a peripheral rim 112 which is delimited, opposite said cup, by an upper surface 113. The cup and the rim together define a housing 114 seen in FIGS. 3 and 4.

Support 110 may either be an independent part that is pressed in or attached by any other known means to the frame of the timepiece movement, or form part of another component of the movement, such as a bridge or a plate.

A pivot system 120 extending along an arbor D is placed inside housing 114, defined by cup 111 and rim 112. This pivot system 120 includes a circular base 121 in the form of a disc. This base 121 may be made of a metal or single crystal type material, such as silicon or a polycrystalline type material such as ceramic or ruby or sapphire.

This circular base 121, seen in FIG. 3, is a one-piece element 127 which serves as pivot element 122, i.e. it is provided with a blind or through hole 12 in which the arbor shank engages. The diameter of the hole is calculated such that the shank engaged therein can turn freely with a minimum clearance.

Pivot system 120 also includes elastic return means 123. These elastic return means 123 are formed by at least one elastic curved arm 124 and are attached by one end to the periphery of circular base 121. These elastic return means 124 are selected to have a reaction force both along the arbor and perpendicularly thereto. This means that pivot system 120 is capable of reacting in the event of an axial shock or a radial shock.

Advantageously according to the invention, the ends of curved arms 124 which are not attached to the circular base are left free. This feature makes it possible to obtain a more compact pivot system 120 compared to prior art systems since it has a smaller surface area.

Preferably, elastic return means 123 are formed by three curved arms 124 each having a point of attachment to base 121 and which are angularly offset by 120°. It is clear that the elastic function could be ensured using a different number of arms 124, or with different shapes.

Figure 4:
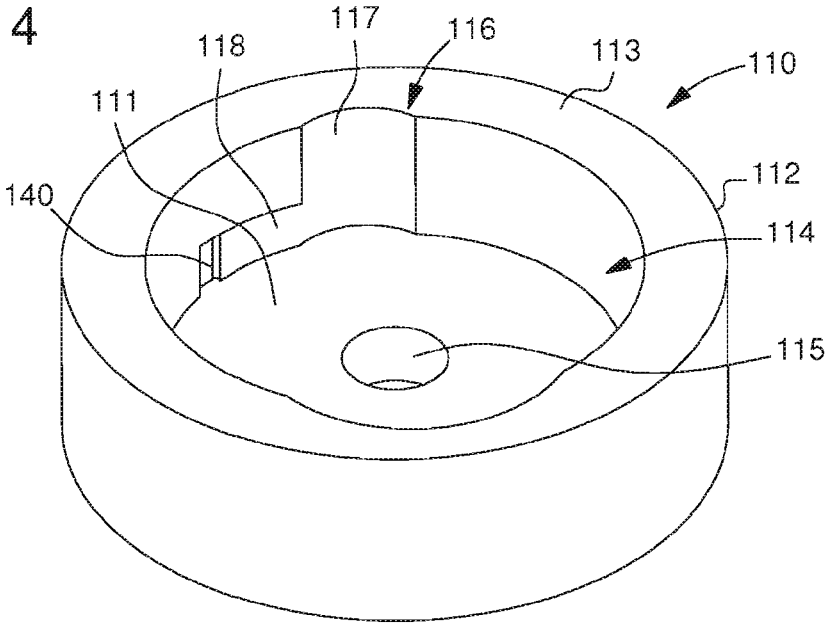
FIG. 4 is a schematic view of the support of the shock absorber device according to the invention.

To fix pivot system 120 in support 110, the present invention advantageously proposes to use a bayonet fitting system as seen in FIG. 4.

To achieve this, rim 112 includes at least one cavity 116 in the thickness thereof. This cavity 116 is formed by a recess 117, which is parallel to said arbor D and open on upper surface 113, and a blind groove 118, which is secant with said first recess and opposite upper surface 113. This groove 118 is used for locking a curved arm 124 of said pivot system in a bayonet fitting.

In the case where elastic return means 113 include three curved arms 124, three cavities 116 are provided.

Pivot system 120 is mounted in housing 114 so that the free ends of curved arms 124 can be inserted into recess 117. The pivot system can then be inserted in the housing so that it is close to base cup 111. When the pivot system reaches an abutment position, the curved arms must be facing grooves 118. Consequently, a rotational motion is made to insert the free ends of curved arms 124 into said grooves 118 and to secure said pivot system in support 110.

This method of securing pivot system 120 in support housing 110 has the advantage of creating less stress. Indeed, because the ends of the curved arms are free, the elastic curved arms are independent of each other as they are not connected to each other and can simply deform.

The geometry of groove 118 or of recess 117 may be varied. It will thus be clear that groove 118 or recess 117 may be cylindrical or parallelepiped or elliptical.

Likewise, it is possible to adapt the dimensions of recess 117 or groove 118 as required. For example, it is possible for recess 117 to extend over all or part of the height of rim 112. If the recess extends over the entire height of the rim, after assembly in support 110, pivot system 120 will be in contact with the bottom of housing 114, i.e. with cup 111. However, if the recess does not extend over the entire height of rim 112, the pivot system is no longer in contact with cup 111. This therefore provides it with greater freedom of movement than if recess 117 extends over the entire height of rim 112.

Figure 5:
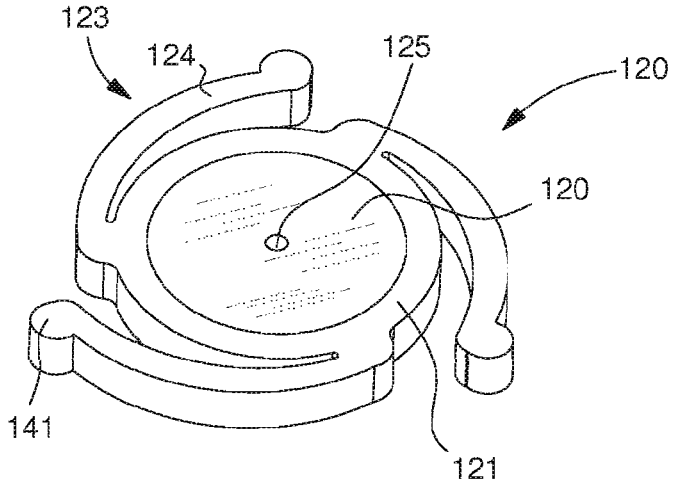
FIG. 5 is a schematic bottom view of the pivot system of the shock absorber device according to an example embodiment of the invention.

In an advantageous variant, the locking of pivot system 120 in housing 114 is improved. To achieve this, each curved arm 124 has at the free end thereof a catch 141 extending radially with respect to the central arbor D of circular base 121 as seen in FIGS. 4 and 5. Each blind groove 118 therefore includes an additional hollow 140 which is thus of greater depth than groove 118. This additional hollow allows a catch 141 to be engaged therein.

Consequently, when pivot system 120 is set in place, arms 124 provided with catches 141 engage in each recess 117 then, during rotation, the difference in depth causes an elastic deformation of arms 124. This elastic deformation is manifested by curved arms 124 moving closer to circular base 121. When the catch 141 located at the free and of each arm 124 is positioned facing the hollow 140 of groove 118, the stress applied to arms 124 is relaxed so that said arms tend to return to their rest position. The catch of each arm is thus inserted in said hollow and blocks the rotation of the pivot system.

It is possible to envisage that the recess and the hollow have a similar depth.

In a second embodiment, circular base 121 has a central orifice 121*a* (not shown) in which a pivot element 122 is accommodated. This configuration allows circular base 121 and elastic return means 123 to be made of a first material and pivot element 122 of a second material. The first and second materials can thus be selected according to requirements. For example, a material having elastic properties will be preferred for arms 124, while a hard material having some friction and wear resistant properties will be preferred for pivot element 122.

Figure 6:
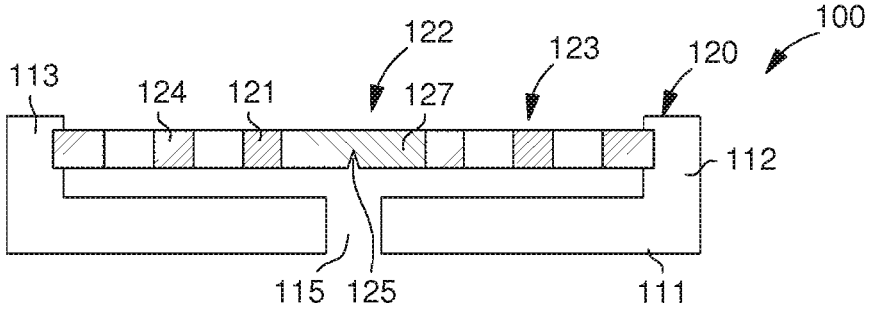
FIGS. 6 and 7 are schematic views of example embodiments of a shock absorber device according to the invention.

In a first example embodiment seen in FIGS. 5 and 6, pivot element 122 takes the form of a single jewel 127, for example made of ruby. This single jewel 127 is placed in orifice 121*a* of circular base 121 and is provided with a blind or through hole in which the arbor shank engages. The diameter of the hole is calculated such that the shank engaged therein can turn freely with a minimum clearance. The single jewel 127 is secured in orifice 121*a* of circular base 121 by pressing-in, adhesive bonding or welding or any other possible method. The advantage of this embodiment is that it provides a pivot system 120 that comprises only two parts: the single jewel 127 acting as the pivot element and circular base 121 which includes arms 124.

Figure 7:
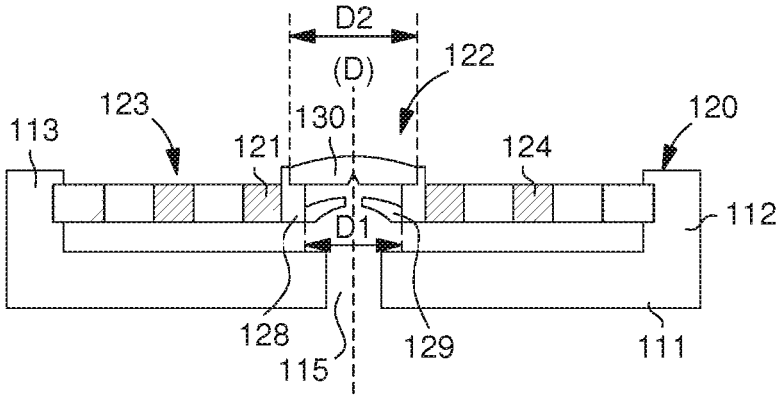

In a second example embodiment seen in FIG. 7, the pivot element includes a setting 128 in which a jewel hole 129, traversed by the arbor shank, and an endstone 130 are secured. Setting 128 takes the form of a tubular part having an outer face and an inner face and an inner diameter D1. The inner face has a shoulder such that setting 128 has an area with a second inner diameter D2. Preferably, diameter D2 is greater than diameter D1. This makes it possible for jewel hole 129 to be inserted in diameter D1 and for an endstone 130 to be inserted in diameter D2 and abut against the shoulder. It is assumed, in that case, that jewel hole 129 has a smaller diameter than that of endstone 130. However, the reverse configuration is also possible.

Setting 128 is then placed in orifice 121*a* of circular base 121 and fixed, for example, by pressing-in, adhesive bonding or welding. This second example embodiment has the advantage of using the setting 128, jewel holes 129 and endstones 130 employed in a convention shock absorber device. Secondly, this second example allows for easier lubricant storage.

In a variant of this second example embodiment, setting 128 and circular base 121 are made in one-piece so that jewel hole 129 and endstone 130 are secured directly in said circular base.

Figure 8:
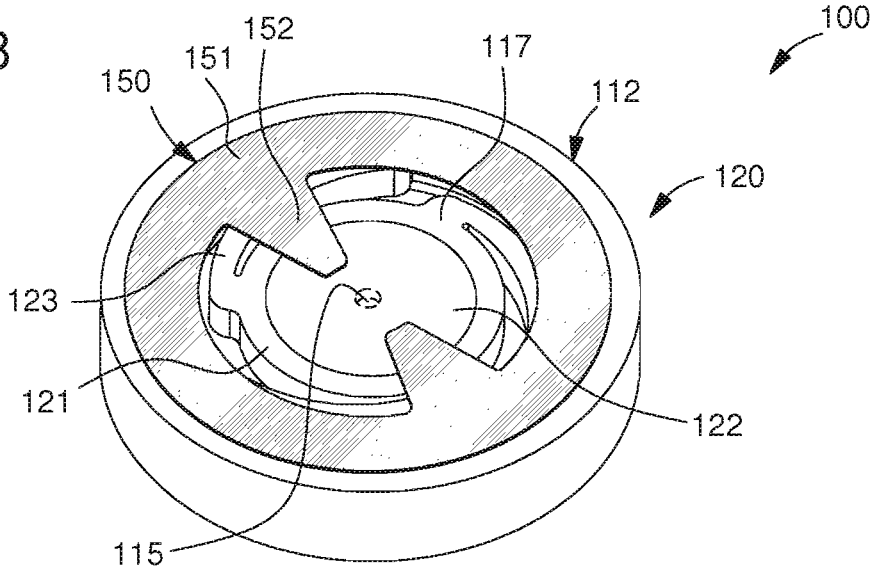
FIGS. 8 and 9 are schematic views of a second embodiment of a shock absorber device according to the invention.
Figure 9:
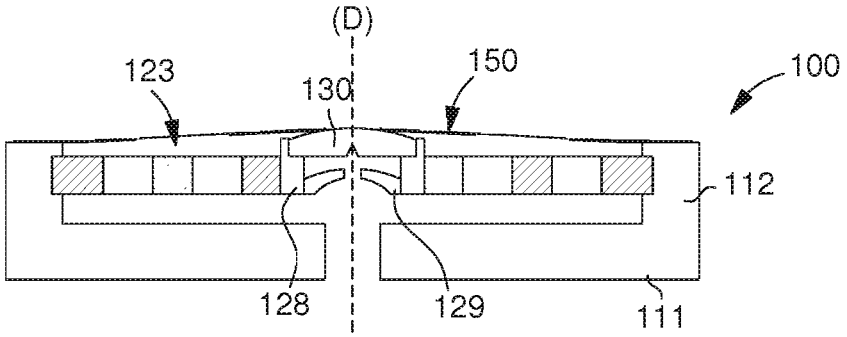

A second embodiment visible in FIGS. 8 and 9 envisages improving the absorption of axial shocks. To achieve this, the shock absorber device according to the second embodiment also includes an additional spring 150. This additional spring 150 is a flat lyre-shaped spring, i.e. it takes the form of an open ring including a joint or hinge and two locking tabs. The joint or hinge and the two locking tabs are diametrically opposite. Securing areas are thus created on the rim of the support in order to secure said additional spring. The attachment must be achieved such that a prestress is applied to pivot system 120. In the event of an axial shock, a stress is applied to pivot system 120 via the arbor shank, with curved arms 124 deforming accordingly. A stress is then applied to additional spring 150 which will deform elastically. When the stress due to the axial shock fades away, additional spring 150 tends to return to its initial position and to return said pivot system 120 to its rest position.

It is, however, possible to envisage that the additional spring is a closed, flat, annular spring 151 having a plurality of strips 152 extending towards the central axis of said annular spring 151. This annular spring 151 can then be adhesive bonded or welded to the upper face of the rim as seen in FIG. 9.

Figure 10:
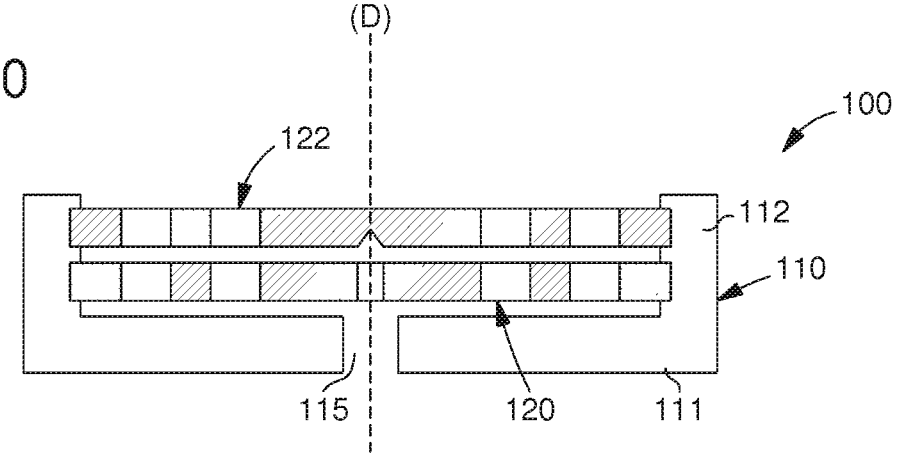
FIG. 10 is a schematic view of a third embodiment of a shock absorber device according to the invention.

In a third embodiment visible in FIG. 10, it can be provided that the shock absorber device 100 includes two pivot systems 120. These pivot systems are advantageously mounted in housing 114 on support 110 by a bayonet fitting system. To achieve this, several possibilities may be envisaged.

A first possibility consists in using the same cavity 116 for both pivot systems 120. This cavity 116 is thus formed by a recess 117, which is parallel to said arbor D and open on upper surface 113, and two blind grooves 118, which are secant with said first recess and opposite upper surface 113. These two grooves 118 are parallel and each is used for locking one curved arm 124 of one pivot system in a bayonet fitting. The space between the two pivot systems 120 is thus defined by the space between the two grooves 118.

A second possibility consists in having two separate cavities 116, one for each pivot system 120. Each cavity 116 is formed by a recess 117, which is parallel to said arbor D and open on upper surface 113, and a blind groove 118, which is secant with said first recess and opposite upper surface 113. This groove 118 is used for locking a curved arm 124 of said pivot system in a bayonet fitting. The two cavities are therefore configured to be offset angularly and to be located on different planes. It is therefore understood that, during the assembly of the two pivot systems 120, a space appears between the two pivot systems 120.

In both possibilities, the pivot system may be made entirely in one-piece as in FIG. 3, or have a setting or single jewel inserted in central orifice 121*a* of base 121. This configuration with two pivot systems also means that the bottommost pivot system in the housing is provided with a through hole so that the arbor shank can be inserted and be supported on the second pivot system.

Of course, the offset angle between the two cavities may be any angle.

Further, it will be understood that this third embodiment is not simply limited to two pivot systems 120 and that a plurality of pivot systems 120 may be arranged in housing 114 of support 110.

It will be clear that various alterations and/or improvements evident to those skilled in the art may be made to the various embodiments of the invention described in this description without departing from the scope of the invention.

The invention claimed is:

1. A shock absorber device for an arbor of a timepiece element, comprising:

a support comprising a base cup surmounted by a peripheral rim, which is delimited, opposite the cup, by an upper surface, the cup and the rim together defining a housing;

at least one pivot system extending in a direction perpendicular to an arbor, the at least one pivot system being arranged in the housing and comprising a base comprising elastic return means at a periphery thereof, formed by at least one curved arm integral with and extending from the base, the base comprising a pivot element including a blind or through hole in which a shank of the arbor engages;

wherein the rim comprises in thickness thereof at least one cavity comprising a recess parallel to the arbor which opens on the upper surface, and, secant with the recess and opposite the upper surface, a blind groove used for locking a curved arm of the at least one pivot system in a bayonet fitting; and wherein the pivot element comprises a setting in which are secured a jewel hole, traversed by the arbor shank, and an endstone.

2. The shock absorber device according to claim 1, wherein the at least one arm comprises a free end engaging in the at least one groove.

3. The shock absorber device according to claim 2, wherein the groove comprises a hollow in which a catch, located at the free end of the at least one curved arm, is inserted.

4. The shock absorber device according to claim 1, wherein the pivot element and the base are made in one-piece.

5. The shock absorber device according to claim 1, wherein the elastic return means comprises three curved arms angularly offset by 120°, the rim comprising three cavities in the thickness thereof.

6. The shock absorber device according to claim 1, further comprising an additional spring which, in event of an axial shock, returns the arbor to its initial position.

7. The shock absorber device according to claim 6, wherein the additional spring is a lyre-shaped spring taking a form of an open ring comprising a hinge and two locking tabs.

8. The shock absorber device according to claim 6, wherein the additional spring is a flat annular spring taking a form of a closed ring comprising shoulders extending towards the arbor.

9. The shock absorber device according to claim 1, comprising two pivot systems using a same cavity for locking one curved arm of each pivot system in a bayonet fitting.

10. The shock absorber device according to claim 1, comprising two pivot systems each using a cavity for locking one curved arm of the pivot system in a bayonet fitting.

* * * * *